US005869793A

United States Patent [19]

Berger et al.

[11] Patent Number: 5,869,793

[45] Date of Patent: Feb. 9, 1999

[54] OVAL SHAPED SPARK ARRESTING MUFFLER FOR ENGINES

[75] Inventors: Christopher J. Berger, South Russell; Terry Goettle, Olmsted Township, both of Ohio; Peter Levin, Davis, Calif.

[73] Assignee: Supertrapp Industries, Inc., Cleveland, Ohio

[21] Appl. No.: 987,414

[22] Filed: Dec. 9, 1997

Related U.S. Application Data

[60] Provisional application No. 60/032,397, Dec. 11, 1996.

[51] Int. Cl.[6] ..... F01N 1/24

[52] U.S. Cl. ..... 181/256; 181/252; 181/230; 181/231

[58] Field of Search ..... 181/230, 231, 181/241, 252, 256, 257, 268, 275, 278, 282

[56] References Cited

U.S. PATENT DOCUMENTS

| | | | |
|---|---|---|---|
| 734,749 | 7/1903 | Rauch . | |
| 855,913 | 6/1907 | Webster . | |
| 951,770 | 3/1910 | Miller . | |
| 1,040,628 | 10/1912 | Cormack . | |
| 1,059,910 | 4/1913 | Russell et al. . | |
| 1,266,255 | 5/1918 | Harris . | |
| 1,351,698 | 8/1920 | Shuman et al. . | |
| 2,045,135 | 6/1936 | Hanson . | |
| 2,954,839 | 10/1960 | Gibel . | |
| 3,779,342 | 12/1973 | Broberg, Jr. . | |
| 3,880,252 | 4/1975 | Mucka . | |
| 3,987,867 | 10/1976 | Moller . | |
| 4,090,583 | 5/1978 | Leonard . | |
| 4,093,110 | 6/1978 | Johnson . | |
| 4,113,051 | 9/1978 | Moller . | |
| 4,119,174 | 10/1978 | Hoffman | 181/231 |
| 4,424,882 | 1/1984 | Moller | 181/231 |
| 4,541,506 | 9/1985 | Venning et al. . | |
| 4,598,791 | 7/1986 | Bates . | |

FOREIGN PATENT DOCUMENTS

| | | |
|---|---|---|
| 361310 | 6/1906 | France . |
| 777240 | 2/1935 | France . |
| 472635 | 2/1929 | Germany . |
| 42642 | of 1917 | Sweden . |

OTHER PUBLICATIONS

Supertrapp 1988 Automotive Catalog.

*Primary Examiner*—Khanh Dang

*Attorney, Agent, or Firm*—Fay, Sharpe, Beall, Fagan, Minnich & McKee

[57] ABSTRACT

An engine muffler and spark arrester includes an oval shaped outer tube extending along an axis and having an inlet end and an outlet end. A plurality of substantially identical nested oval shaped disks are disposed coaxially adjacent the outlet end. Each of the disks has an oval shaped centrally located aperture. An inner tube is disposed coaxially within the outer tube. The inner tube has a circular inlet end and an oval-shaped outlet end. An oval end cap is disposed adjacent the disks. A sound absorbent material can be disposed in a cavity defined between the inner tube and the outer tube. An oval-shaped inlet cap is secured to the inlet end of the outer tube with the inlet cap having a circular centrally located aperture extending therethrough. An oval-shaped outlet cap is secured to the outlet end of the outer tube. The outlet cap has an oval-shaped centrally located aperture extending therethrough. The inner tube has a circular distal end extending through the centrally located aperture of the inlet cap and an oval proximal end extending through the centrally located aperture of the outlet cap.

18 Claims, 8 Drawing Sheets

ROUND VS OVAL DISC COMPARISON

| DISC SHAPE | DISC NOMINAL OD | | DISC ID | | HOLE AREA, SQ INCHES | EFFECTIVE HOLE DIA, INCHES | ANNULAR FLOW AREA/DISC, SQ INCHES | #DISCS TO EQUAL HOLE AREA | DISC MATERIAL WEIGHT,LB | EFFICIENCY: FLOW AREA/ MAT WEIGHT |
|---|---|---|---|---|---|---|---|---|---|---|
| | MINOR | MAJOR | MINOR | MAJOR | | | | | | |
| ROUND | 3.0 | 3.0 | 1.645 | 1.645 | 2.13 | 1.65 | 0.12 | 18 | 0.073 | 1.64 |
| ROUND | 4.0 | 4.0 | 2.430 | 2.430 | 4.64 | 2.43 | 0.18 | 26 | 0.124 | 1.42 |
| ROUND | 5.0 | 5.0 | 3.020 | 3.020 | 7.16 | 3.02 | 0.22 | 33 | 0.185 | 1.18 |
| OVAL | 3.0 | 4.0 | 1.645 | 2.645 | 3.77 | 2.19 | 0.16 | 23 | 0.095 | 1.74 |
| OVAL | 3.0 | 4.5 | 1.645 | 3.145 | 4.59 | 2.42 | 0.19 | 24 | 0.106 | 1.77 |
| OVAL | 3.0 | 5.0 | 1.645 | 3.645 | 5.42 | 2.63 | 0.21 | 26 | 0.117 | 1.80 |
| OVAL | 3.0 | 5.5 | 1.645 | 4.145 | 6.24 | 2.82 | 0.23 | 27 | 0.128 | 1.82 |
| OVAL | 3.0 | 6.0 | 1.645 | 4.645 | 7.06 | 3.00 | 0.26 | 27 | 0.139 | 1.84 |

FIG. 14

OVAL SHAPED SPARK ARRESTING MUFFLER FOR ENGINES

BACKGROUND OF THE INVENTION

It is well known that substantial muffling of internal combustion engines is necessary in order to reduce objectionable noise. However, it is desirable to reduce the level of exhaust noise without seriously interfering exhaust outflow. A large variety of mufflers have been developed in an attempt to meet these twin objectives for internal combustion engines.

In some environments where internal combustion engines are used, it is mandatory that the emission of glowing carbon particles from the exhaust be prevented so as to avoid fires in the surrounding environment. This is particularly true in applications such as off road motorcycles or "dirt bikes." A spark arresting muffler capable of catching and retaining sparks of carbon and the like discharged by the engine are necessary in such an environment because any sparks which might otherwise escape to the surroundings pose a fire hazard. Various arrangements have been provided for this purpose. One such design is shown in U.S. Pat. No. 3,987,867 issued on Oct. 26, 1976. Another such design is illustrated in the U.S. Pat. No. 4,113,051 patent which issued on Sep. 12, 1978. U.S. Pat. Nos. 3,987,867 and 4,113,051 are both owned by the assignee of the instant application. Both of these patents are incorporated into this specification by reference in their entireties.

The known muffler and spark arrester designs have an enclosure including a perforated inner tube which is coaxially located within an outer tube. A sound absorbent material is placed between the tubes. At the outlet end of the inner and outer tubes there is provided a gas barrier wall with a partially toroidal concave configuration. Against this wall nests a plurality of partially toroidal disks slightly spaced apart by edge dimples.

One of the problems with the conventional mufflers described in the two patents referenced above is that they employ circular disks. Unfortunately, the "disk efficiency" of circular disks decreases as their diameter increases. This is because the material required for the disk increases by the outer diameter of the disk squared but the flow area of the disk only increases in direct proportion to the disk's diameter.

Another disadvantage of the conventional mufflers illustrated in the two above-identified patents is that they are relatively large in size and do not meet today's needs for streamlined mufflers in both motorcycles and cars, as well as in other types of vehicles, such as jet skis.

Accordingly, it has been considered desirable to develop and new and improved muffler system which would overcome the foregoing difficulties and others while providing better and more advantageous overall results.

BRIEF SUMMARY OF THE INVENTION

In accordance of the present invention, a new and improved engine muffler and spark arrester is provided.

More particularly in accordance with this aspect of the invention, the muffler comprises an oval shaped outward tube extending along an axis and having an inlet end and an outlet end. A plurality of substantially identical nested oval shaped disks is disposed coaxially adjacent the outlet end of the outer tube. Each of the disks has an oval shaped centrally located aperture. An inner tube is disposed coaxially within the outer tube. The inner tube has a circular inlet end and an oval shaped outlet end located adjacent the oval shaped disks. An oval end cap is disposed adjacent the disks.

Preferably an axial spacing means, which can be dimples, extends between each two disks. A fastener can extend through a set of aligned apertures defined in each of the disks in order to hold the disks together.

In accordance with another aspect of the present invention, a muffler is provided.

More particularly in accordance with this aspect of the invention, the muffler comprises an oval shaped outer tubular body extending along an axis and having an inlet end and an outlet end. A diffusion section of the muffler comprises a plurality of spaced toroidal disks of oval shape defining an oval shaped central passageway. The diffusion section is located adjacent the outlet end of the outer tubular body. A retaining means is provided for holding the plurality of disks in a spaced apart manner to define a series of transverse open annular passageways. The retaining means preferably fastens the plurality of disks to the outer tubular body. An inner tubular body is disposed within the outer tubular body. The inner tubular body defines an open central passageway communicating with the central passageway of the plurality of disks.

In accordance with still another aspect of the present invention a tuneable engine muffler is provided.

More particularly in accordance with this aspect of the invention, the muffler comprises an oval shaped outer tube extending along an axis and having an inlet end and an outlet end. An oval shaped inlet cap is secured to the inlet end of the outer tube. The inlet cap has a circular centrally located aperture extending therethrough. An oval shaped outlet cap is secured to the outlet end of the outer tube. The outlet cap has an oval shaped centrally located aperture extending therethrough. A plurality of substantially identical oval disks is disposed coaxially adjacent the outlet cap. An inner tube is disposed coaxially with the outer tube. The inner tube has a circular inlet end communicating with the centrally located aperture of the inlet cap and an oval shaped outlet end communicating with the centrally located aperture of the outlet cap. An oval end cap is disposed adjacent the disks.

If desired, a sound absorbent material can be disposed in a cavity defined between the inner and outer tubes. A plurality of spaced apertures can extend through a side wall of the inner tube to allow a flow of gas out through the side wall of the inner tube and into the cavity. An inlet tube can communicate with the inner tube and have one end extending into the distal end of the inner tube. An inlet cap can be provided, which has an outer periphery secured to the outer tube at a centrally disposed aperture through which the inlet tube extends. Preferably, the disks each further comprise axial spacing means. The muffler preferably further comprises a fastener extending through a set of aligned apertures defined in respective ones of the disks in order to hold the disks together.

One advantage of the present invention is the provision of a new and improved muffler having spark arresting features.

Another advantage of the present invention is the provision of a light weight compact muffler which is effective to muffle sounds as well as to arrest sparks while remaining economical to manufacture.

Still another advantage of the present invention is the provision of the muffler which can, with little difficulty, be assembled in a variety of different ways in order to vary its effectiveness under different operating conditions.

Yet another advantage of the present invention is the provision of a muffler in which there is a substantial heat dissipating surface so that the temperature of operation of the muffler, even under heavy conditions, remains at a feasible level so that the muffler has a lengthened life.

A further advantage of the present invention is the provision of a muffler employing oval disks. Oval disks have been found to be more efficient than their circular counterparts of the same minor diameter. More specifically, the disks have an oval shaped central aperture and preferably also have an oval shaped outer periphery.

A still further advantage of the present invention is the provision of a streamlined muffler which is more adapted for the aerodynamic shapes preferred in today's vehicles while still providing the necessary muffling properties for which its use is required.

An additional advantage of the present invention is the provision of a muffler having an oval shaped outer tube and an oval shaped inlet cap having a circular central aperture, wherein the inlet cap is secured to the outer tube. An oval shaped outlet cap, having an oval shaped aperture is also secured to the outer tube. An inner tube, having a circular inlet end and an oval shaped outlet end, is positioned within the outer tube. The inner tube inlet end communicates with the inlet cap aperture and the inner tube outlet end communicates with the outlet cap aperture.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE SEVERAL EMBODIMENTS

Figure 1:
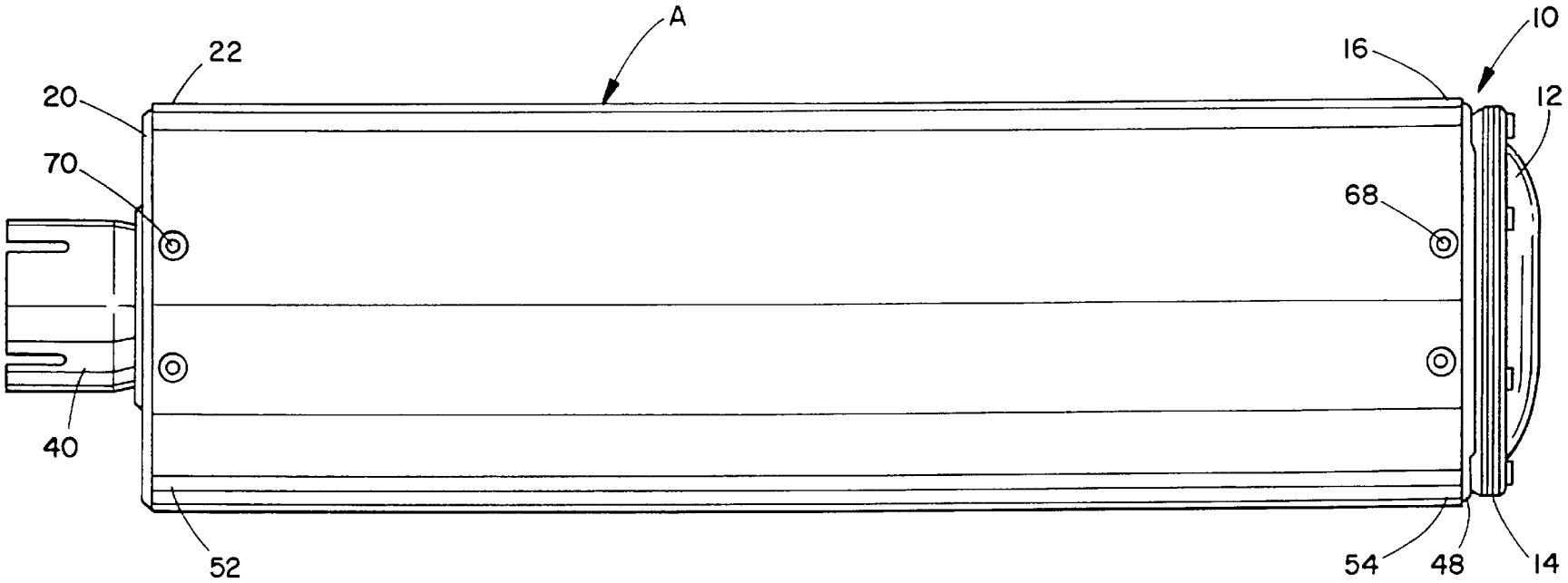
FIG. 1 is a top plan view of a muffler according to a first preferred embodiment of the present invention.

Referring now to the drawings, they are for purposes of illustrating several embodiments of the invention only and not for purpose of limiting same. FIG. 1 shows a muffler A according to the first preferred embodiment of the present invention. The muffler according to the present invention can be used with several types of internal combustion engines. More particularly, the muffler can be employed with vehicles such as automobiles, trucks and motorcycles, especially motorcycles used in a motor-cross or off-road environment where the muffler must trap and retain carbon or other incandescent particles that are a severe fire hazard. There is also an important requirement for good sound dissipation, particularly at frequencies annoying to humans. However, it should be appreciated that the muffler according to the present invention can also be employed in other vehicular environments, such as with jet skis, race boats and the like.

According to the present invention, a series of disks with a precise gap form an exhaust outlet for the muffler. By adding or subtracting disks a person can wave tune the internal combustion engine and the carburation of the vehicle. Adding disks opens the system, increases the exhaust outlet size and makes the vehicle noisier. Removing disks closes the system, decreases the exhaust outlet size and makes the vehicle quieter. The opening and closing of the exhaust exit is very important to tuning. It allows a person to adjust the power band of the vehicle, which is especially important for racing. The addition and subtraction of disks is equivalent to changing header or collector size. With the muffler of the present invention, a much richer jetting will be needed due to the increase of the "available volume" in the combustion chamber. The muffler according to the present invention disperses exhaust gases radially rather than axially. It is, therefore, very effective in reducing noise levels while at the same time not interfering with the performance of the vehicle engine.

Figure 2:
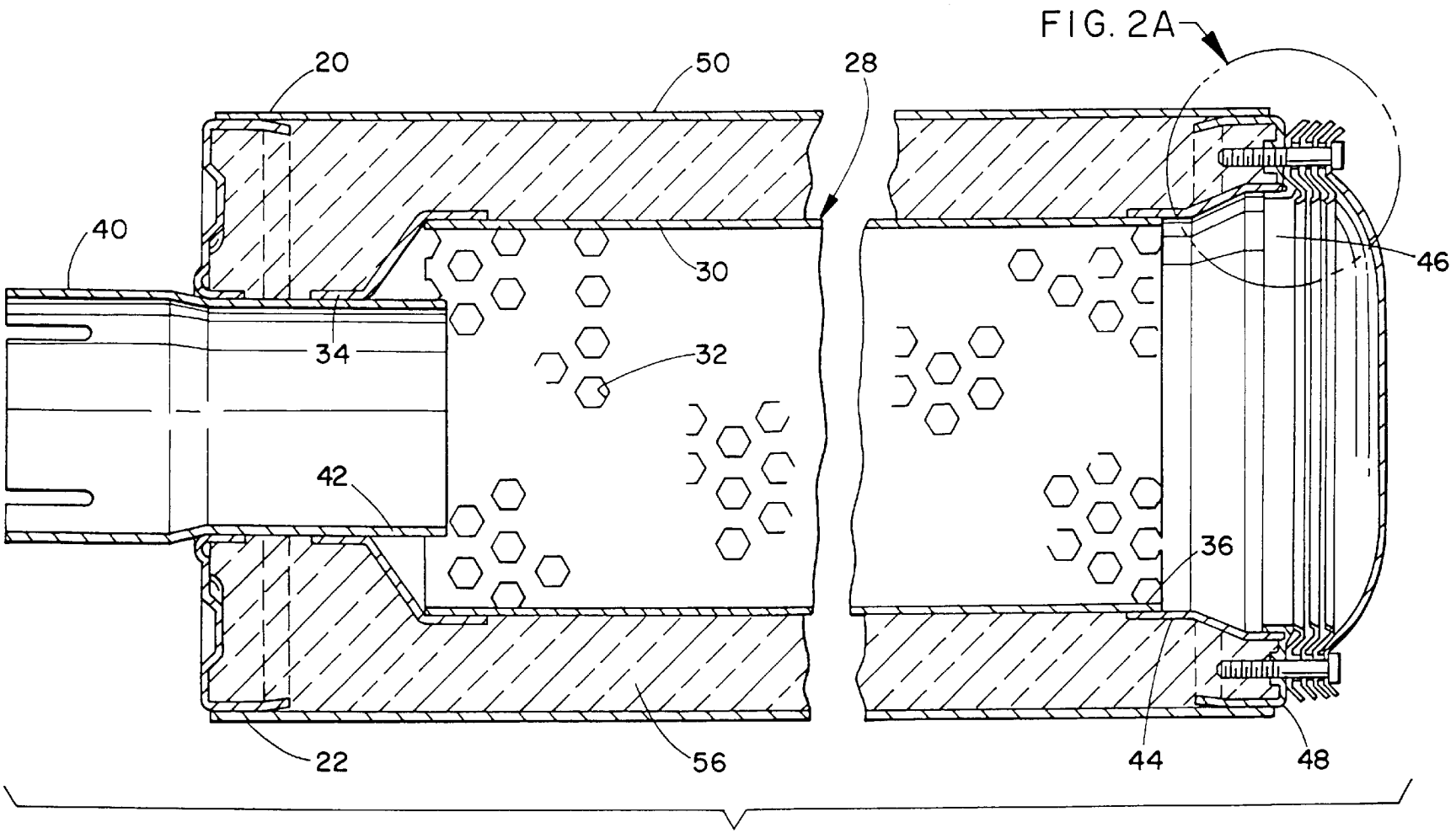
FIG. 2 is an enlarged cross sectional view, partially broken away, of the muffler of FIG. 1.
Figure 10:
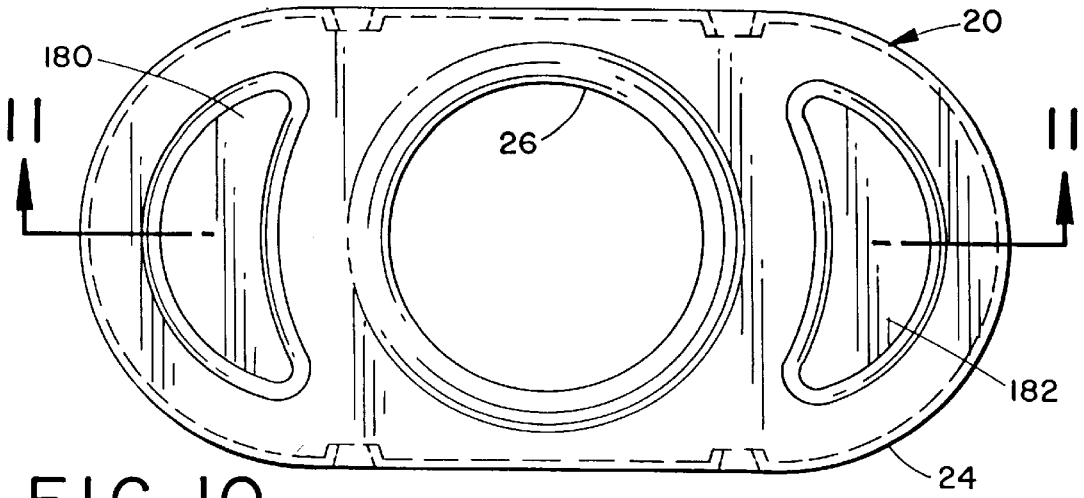
FIG. 10 is a front elevational view of an inlet cap which can be used in the muffler of FIG. 1.

In the muffler A according to the present invention as illustrated in FIG. 1, there is provided an exhaust diffusion section 10 comprising an end cap 12 and a series of disks 14 which are oval in shape. The disks are located at an outlet 16 of the muffler A. With reference now to FIG. 2, an inlet cap 20 is located at an inlet end 22 of the muffler. As shown in FIG. 10, the inlet cap 20 has an oval outer periphery 24 and includes a circular central aperture 26.

With reference again to FIG. 2, a core assembly 28 comprises an inner tube 30 having a plurality of apertures 32 extending therethrough. The inner tube 30 has a circular inlet end 34 and an oval-shaped outlet end 36. An inlet tube 40 extends through the inlet cap 20. The inlet tube 40 has a circular distal end 42 extending into the inlet end 34 of the inner tube. An outlet tube 44 is secured to the outlet end 36 of the inner tube 30. The outlet tube communicates with an oval-shaped central aperture 46 of an outlet cap 48. The core assembly 28 is enclosed in an outer tube or body 50. It should be appreciated that the outer tube 50 is oval-shaped in cross-section whereas the inner tube 30 has, as mentioned, a circular inlet end 34 and an oval-shaped outlet end 36. The outer body or tube 50 has an oval shaped inlet end 52 and an oval shaped outlet end 54.

Figure 2A:
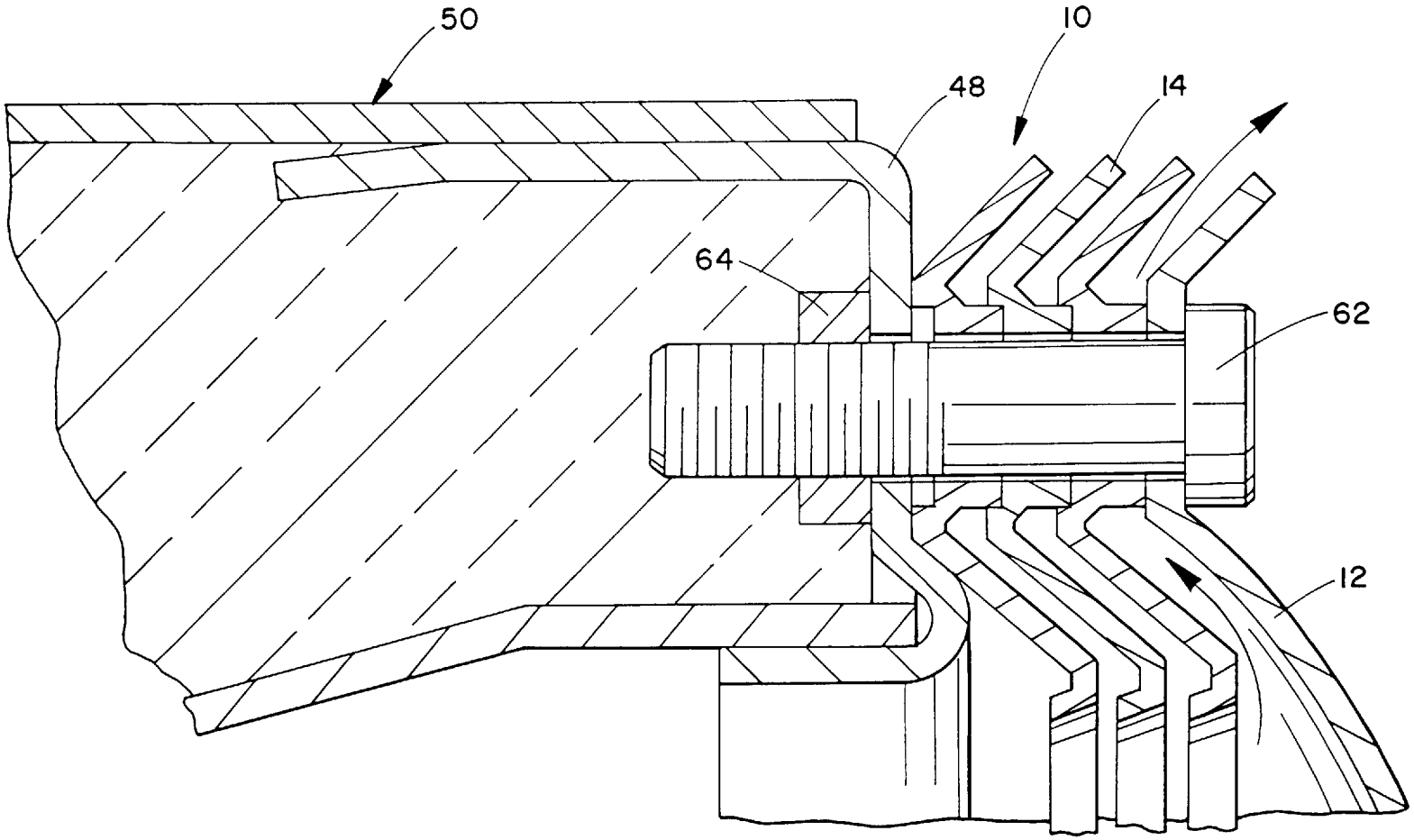
FIG. 2A is a greatly enlarged cross sectional view of a distal end of the muffler of FIG. 2.

Located between the outer body 50 and the inner tube 30 is a layer of a high temperature resistant sound absorbing material 56, such as fiberglass. The fiberglass material is useful for attenuating sound. It should be recognized, however, that other types of sound attenuating or sound absorbing materials could also be employed. With reference now to FIG. 2A, securing the several disks 14 and the end cap 12 to the outlet cap 48 of the muffler A are bolts 62 and nuts 64. The nuts 64 can be fastened to the outlet cap 48 by, e.g. welding or the like. The entire structure forms the exhaust diffusion section 10 of the muffler A. As illustrated in FIG. 1 conventional screws 68 are employed to secure the outlet cap 48 of the diffusion section 10 of the outer tube 50. Similarly, screws 70 are employed to secure the inlet cap 20 to the outer tube 50.

Figure 3:
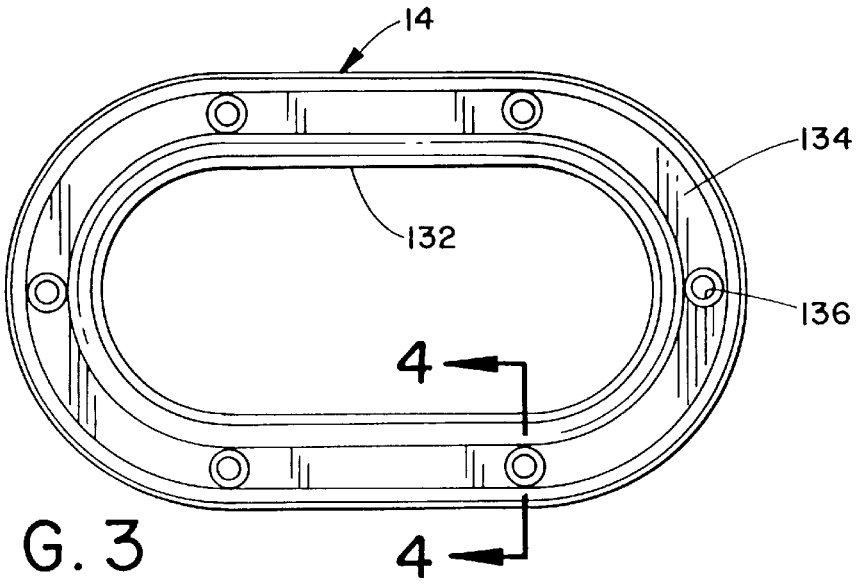
FIG. 3 is a front elevational view of a disk of the muffler of FIG. 1 according to a first preferred embodiment of the present invention.
Figure 4:
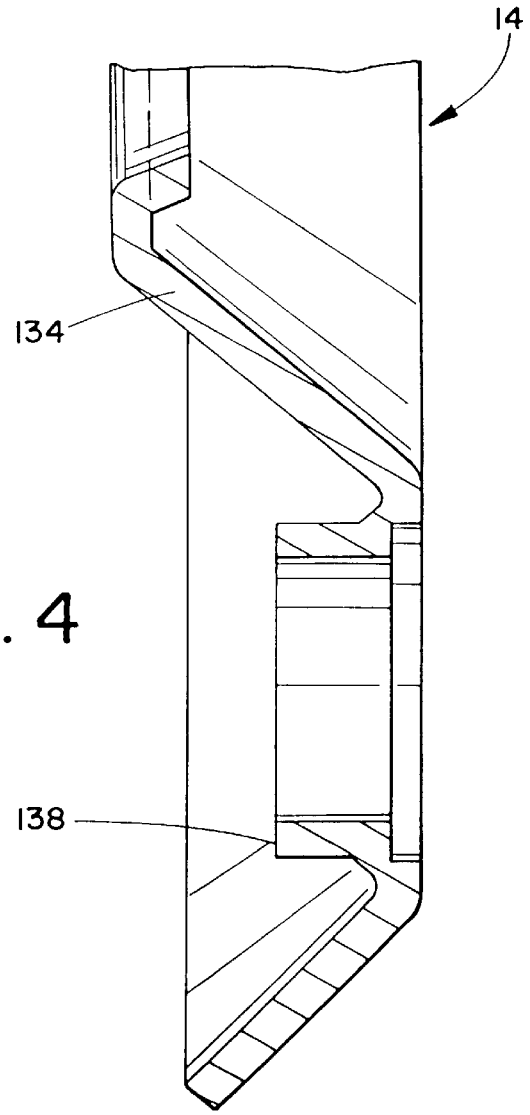
FIG. 4 is a greatly enlarged cross sectional view of the disk of FIG. 3 along line 4—4.

As is best illustrated in FIG. 3, the present invention employs oval shaped disks 14. Extending through each of the disks is a centrally located oval-shaped aperture 132. The aperture 132 is encircled by an oval racetrack-shaped metal band 134 in which a plurality of apertures 136 are located. Respective bolts (such as the bolts 62 illustrated in FIG. 2) can extend through the apertures. Each of the apertures 136 is punched into the disk 130 in such a manner that a circular wall 138 (see FIG. 4) extends away from the plane of the disk. It can be appreciated from the cross-section of FIG. 4 that the band 134 is somewhat "wavy" in cross-section. This shape slows down and speeds up airflow and creates a scavenging effect in the combustion chamber of the engine with which the muffler of the present invention is used.

Figure 5:
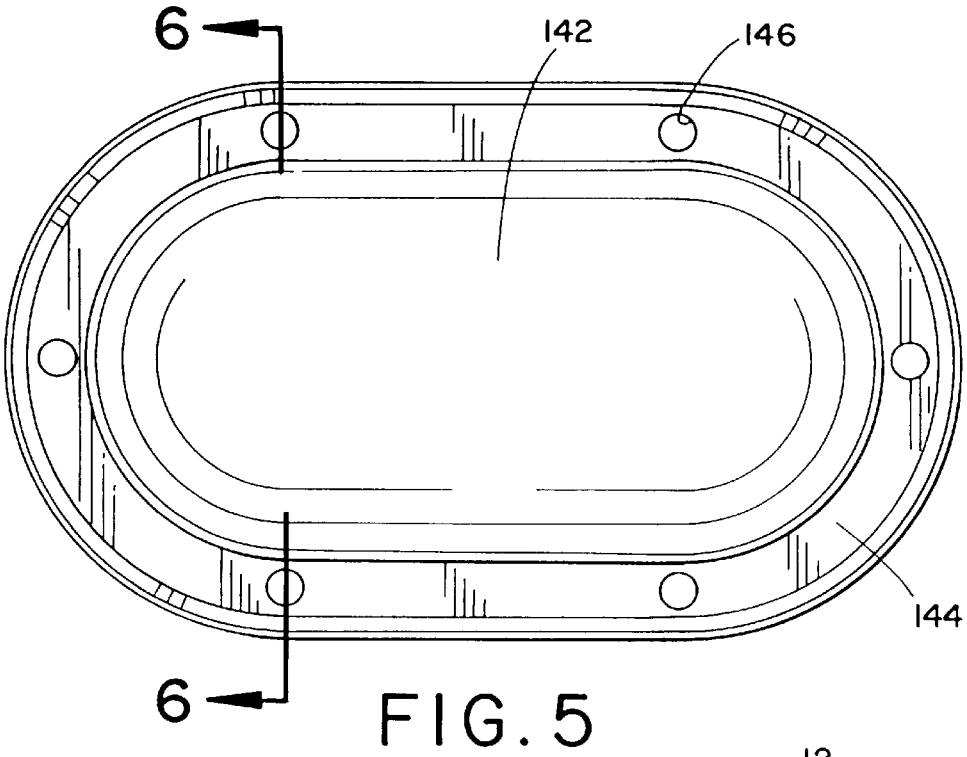
FIG. 5 is an enlarged front elevational view of an end cap for the muffler of FIG. 1.
Figure 6:
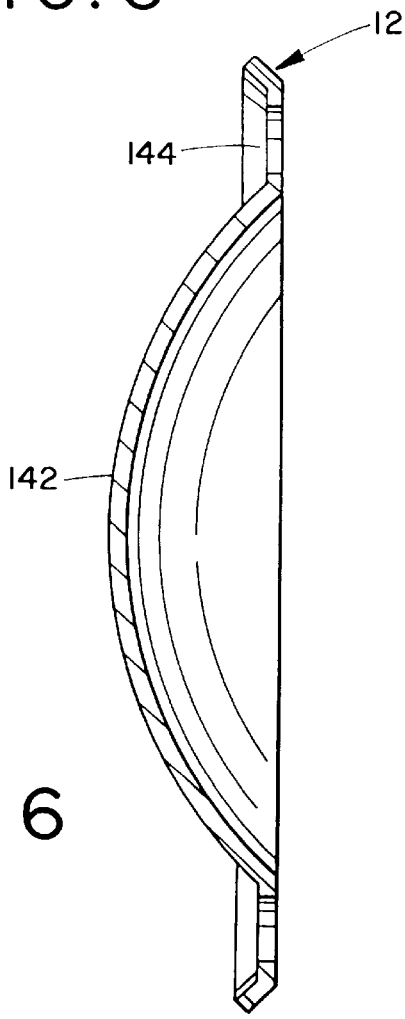
FIG. 6 is a cross sectional view of the end cap of FIG. 5 along line 6—6.

With reference now to FIG. 6, the end cap 12 has a domed central section 142 which is encircled by a planar racetrack-shaped section 144. As best seen in FIG. 5, punched in the planar section are a plurality of spaced holes 146. The holes 146 in the end cap are aligned with the apertures 136 in the disks and suitable fasteners, such as the bolts 62 illustrated in FIG. 2, extend through the end cap and the disks to secure the set of disks together.

Figure 7:
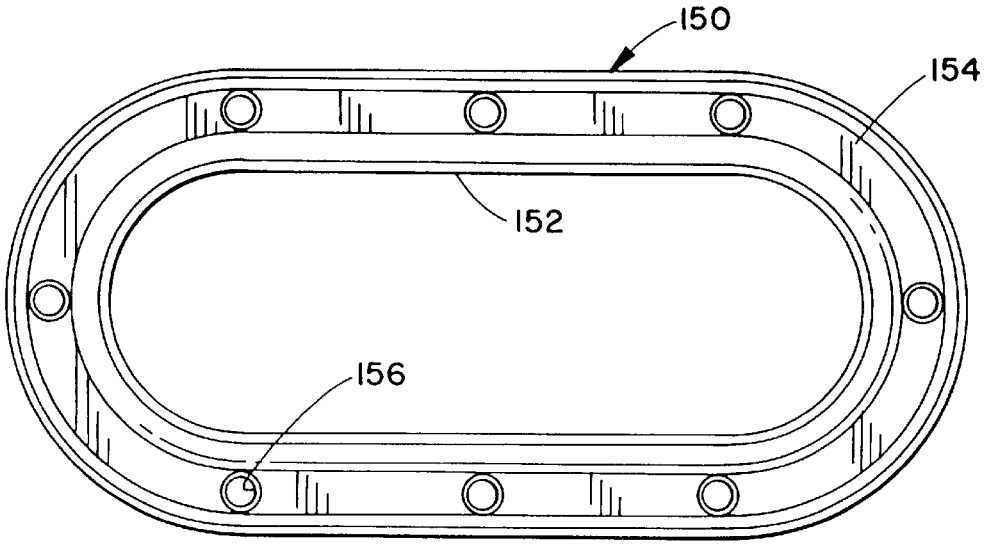
FIG. 7 is a front elevational view of a disk according to second preferred embodiment of the present invention.

FIG. 7 illustrates a disk 150 which has a substantially oval shaped aperture 152 of larger size than the aperture 132 of FIG. 3. The disk 150 also includes a racetrack-shaped area 154 in which a plurality of apertures 156 are defined. FIG. 3 illustrates a disk which is 3" tall and 4½" wide. In contrast, FIG. 7 illustrates a disk which is 3" tall and 6" wide.

Figure 8:
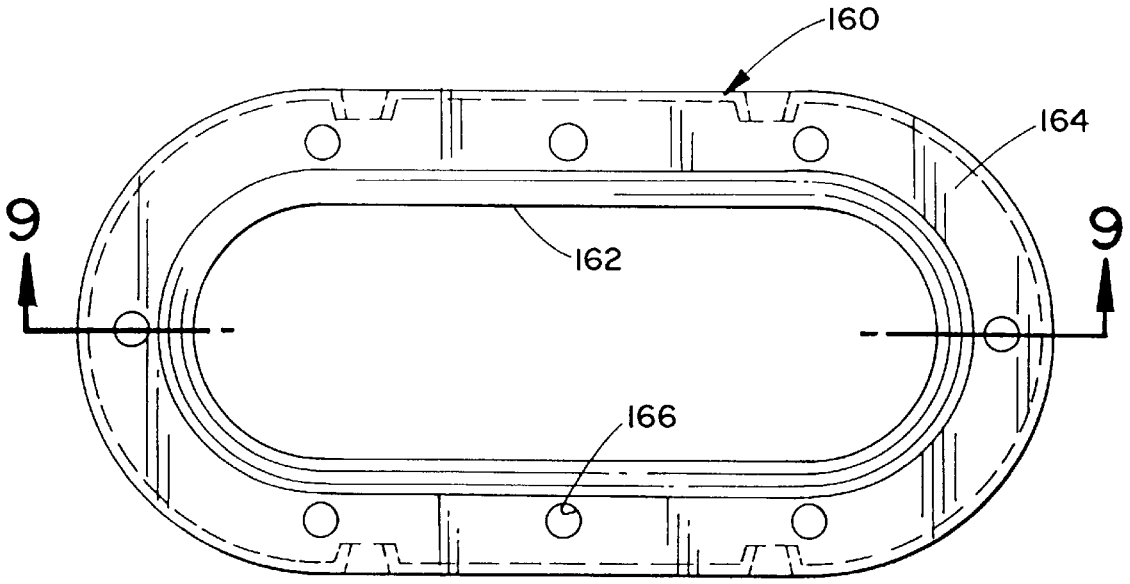
FIG. 8 is a front elevational view of an outlet cap used in connection with the disk of FIG. 7.
Figure 9:
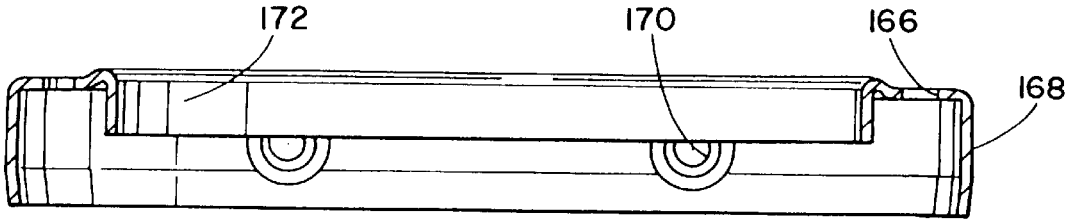
FIG. 9 is a cross sectional view of the outlet cap of FIG. 8 along line 9—9.

FIGS. 8 and 9 illustrate in greater detail an outlet cap 160 which is similar to the outlet cap 48 discussed above. The outlet cap 160 is designed to accommodate the disk 150 of FIG. 7. The outlet cap 160 has an oval shaped central aperture 162. The aperture is defined by a planar oval racetrack-shaped metal band 164 through which a plurality of apertures 166 extend. As best shown in FIG. 9, depending radially outwardly from the band 164 is a skirt-like side wall 168. Located in the side wall are a pair of apertures 170 for accommodating fasteners such as the screws 68 (illustrated in FIG. 1). Depending inwardly from the band 164 is an inner skirt 172 which encircles the central aperture 162.

Figure 11:
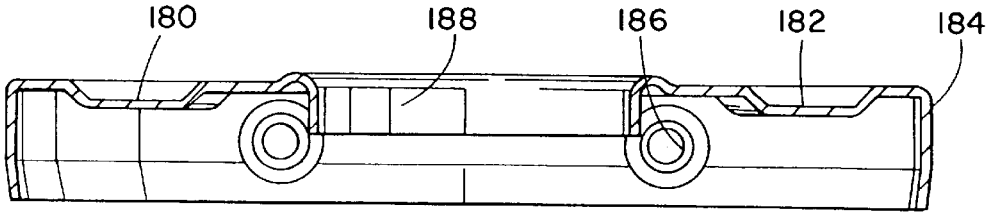
FIG. 11 is a cross sectional view of the inlet cap of FIG. 10 along line 11—11.

FIG. 10 illustrates the inlet cap 20 having the central circular shaped aperture 26. Also located in the cap 20 are a pair of indented areas 180 and 182, one being located on either side of the aperture 26. An inlet tube, like the tube 40 in FIG. 2, can extend through the aperture 26. Extending through an outer side wall 184 of the disk 20 are a pair of apertures 186 as is illustrated in FIG. 11. An inner skirt 188 defines the aperture 26. A suitable fastener, such as the fastener 70 illustrated in FIG. 1, can extend through aligned apertures in the outer tube and the inlet cap to secure the inlet cap in place.

Figure 12:
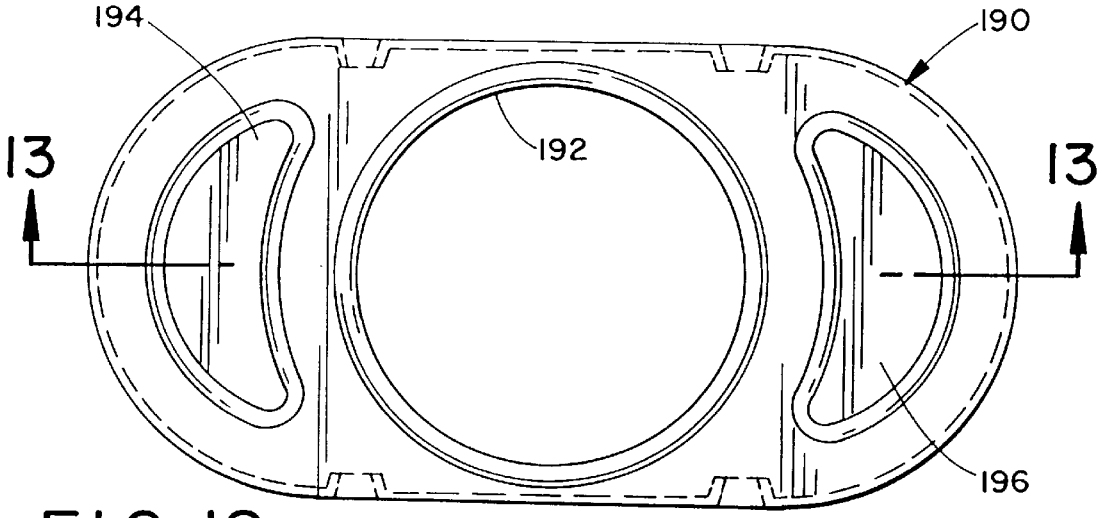
FIG. 12 is a front elevational view of another type of inlet cap which can be used with the muffler of the present invention according to a third preferred embodiment of the present invention.
Figure 13:
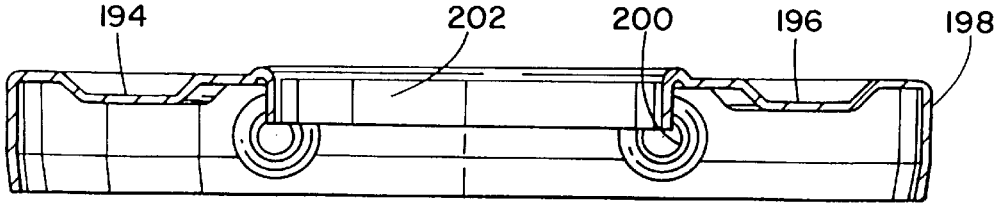
FIG. 13 is a cross sectional view of the inlet cap of FIG. 12 along the line 13—13; and, FIG. 14 is a chart comparing the efficiency of round disks and oval disks.

With reference now to FIG. 12, another inlet cap 190 of a different size is there illustrated. This cap has a substantially circular central aperture 192. Located on either side of the aperture are a pair of indented areas 194 and 196. As shown in FIG. 13, extending through a skirt-like outer side wall 198 of the disk are a pair of apertures 200. An inner skirt 202 surrounds the central aperture 192.

The disks according to the present invention can be manufactured in a variety of sizes. For example, a 3"×4½", a 3"×6" or a 3"×8" oval disk could be employed with a suitably shaped muffler.

Applicants have discovered that oval disks, of any size, are more efficient than are their circular counterparts of the same minor diameter. In order to maximize the perimeter flow area for a given disk size, applicants have determined that the more elongated a disk is made, the more efficient it is. As shown in the enclosed chart of FIG. 14, even a 3"×4½" oval disk has the same flow area as a round 4" disk. But, the oval disk is 25% more efficient (1.77 v. 1.42) when measuring flow area versus material weight. Applicants have developed a disk efficiency formula in which disk efficiency equals flow area per disk (inside perimeter) divided by unit material weight (cost). As another example, a 3"×6" oval disk has the same flow area as a round 5" disk but the oval disk is 56% more efficient (1.84 v. 1.18).

The invention has been described with reference to several embodiments. Obviously, modifications and alterations will occur to others upon the reading and understanding of this specification. It is intended to include all such modifications and alterations as would be apparent to one of average skill in the art.

What is claimed is:

1. An engine muffler and spark arrester comprising:

an oval shaped outer tube extending along an axis and having an inlet end and an outlet end;

a plurality of substantially identical, nested, oval shaped disks disposed coaxially adjacent said outlet end of said outer tube wherein each of said disks has an oval shaped centrally located aperture;

an inner tube disposed coaxially within said outer tube, wherein said inner tube has a circular inlet end and an oval-shaped outlet end located adjacent said oval-shaped disks; and, an oval end cap disposed adjacent said disks.

2. The muffler of claim 1 further comprising a sound absorbent material disposed in a cavity defined between said inner tube and said outer tube.

3. The muffler of claim 2 further comprising a plurality of spaced apertures extending through a side wall of said inner tube to allow a flow of gas out through said side wall of said inner tube and into said cavity.

4. The muffler of claim 1 further comprising an inlet tube communicating with said inner tube and having one end extending into said distal end of said inner tube.

5. The muffler of claim 1 further comprising an inlet cap having an outer periphery secured to said outer tube and a centrally disposed aperture through which said inlet tube extends.

6. The muffler of claim 1 wherein said disks each further comprise axial spacing means.

7. The muffler of claim 1 further comprising a fastener extending through a set of aligned apertures defined in respective ones of said disks to hold said disks together.

8. A muffler comprising:

an oval shaped outer tubular body extending along an axis and having an inlet end and an outlet end;

a diffusion section comprising a plurality of spaced toroidal disks of oval shape defining an oval shaped central passageway, said diffusion section being located adjacent said outlet end of said outer tubular body;

retaining means for holding said plurality of disks in a spaced apart manner to define a series of transverse open annular passageways, said retaining means operably fastening said plurality of disks to said outer tubular body;

an inner tubular body disposed within said outer tubular body, said inner tubular body defining an open central passageway communicating with said central passageway of said plurality of disks;

a sound absorbent material disposed in a cavity defined between said inner tube and said outer tube; and, a plurality of spaced apertures extending through a side wall of said inner tube to allow a flow of gas out through said side wall of said inner tube.

9. The muffler of claim 8 further comprising an oval end cap disposed adjacent said disks.

10. A muffler comprising:

an oval shaped outer tubular body extending along an axis and having an inlet end and an outlet end;

a diffusion section comprising a plurality of spaced toroidal disks of oval shape defining an oval shaped central passageway, said diffusion section being located adjacent said outlet end of said outer tubular body;

retaining means for holding said plurality of disks in a spaced apart manner to define a series of transverse open annular passageways, said retaining means operably fastening said plurality of disks to said outer tubular body;

an inner tubular body disposed within said outer tubular body, said inner tubular body defining an open central passageway communicating with said central passageway of said plurality of disks; and, an inlet tube communicating with said inner tube and having one end extending into an inlet end of said inner tube.

11. The muffler of claim 10 further comprising an inlet cap having an outer periphery secured to said outer tube and a centrally disposed aperture through which said inlet tube extends.

12. The muffler of claim 8 wherein said retaining means comprises a fastener extending through a set of aligned apertures defined in respective ones of said disks to hold said disks together.

13. The muffler of claim 12 wherein said retaining means further comprises nested dimples located on each of said disks.

14. A tunable engine muffler comprising:

an oval shaped outer tube extending along an axis and having an inlet end and an outlet end;

an oval shaped inlet cap secured to said inlet end of said outer tube, said inlet cap having a circular centrally located aperture extending therethrough;

an oval shaped outlet cap secured to said outlet end of said outer tube, said outlet cap having an oval shaped centrally located aperture extending therethrough;

a plurality of substantially identical, nested, oval disks disposed coaxially adjacent said outlet cap;

an inner tube disposed coaxially within said outer tube, wherein said inner tube has a circular inlet end communicating with said centrally located aperture of said inlet cap and an oval-shaped outlet end communicating with said centrally located aperture of said outlet cap; and, oval end cap disposed adjacent said disks.

15. The muffler of claim 14 wherein said disks each further comprise axial spacing means.

16. The muffler of claim 15 wherein said retaining means comprises a plurality of dimples defined in each of said disks, wherein said dimples are nested in relation to each other.

17. The muffler of claim 14 further comprising a fastener extending through a set of aligned apertures defined in respective ones of said disks to hold said disks together.

18. The muffler of claim 14 wherein said end cap comprises a domed central section.

* * * * *